United States Patent [19]

Umetani et al.

[11] 4,095,945

[45] Jun. 20, 1978

[54] PROCESS FOR TREATING TEXTILE ARTICLES

[75] Inventors: Kohei Umetani; Masakazu Date, both of Takatsuki, Japan

[73] Assignee: Toyo Boseki Kabushiki Kaisha, Osaka, Japan

[21] Appl. No.: 707,938

[22] Filed: Jul. 23, 1976

[51] Int. Cl.[2] ..... D06M 9/00; D06M 13/28; C09D 5/18

[52] U.S. Cl. ..... 8/115.7; 8/116 P; 252/8.8 R; 252/8.8 AN; 252/8.1; 427/390 D; 428/276; 106/15 FP

[58] Field of Search ..... 427/390 D; 8/116 P, 8/115.7; 252/8.8 R, 8.8 AN, 8.8 AA, 8.8 AP; 428/276; 106/15 FP

[56] References Cited

U.S. PATENT DOCUMENTS

| | | | |
|---|---|---|---|
| 2,810,701 | 10/1957 | Reeves et al. | 8/116 P |
| 3,221,057 | 11/1965 | Gordon et al. | 260/2 P |
| 3,878,245 | 4/1975 | Nachbur et al. | 260/553 R |
| 3,931,310 | 1/1976 | Nachbur et al. | 260/551 P |
| 3,956,243 | 5/1976 | Loss et al. | 8/116 P |

*Primary Examiner*—Joseph L. Schofer
*Assistant Examiner*—Maria S. Tungol
*Attorney, Agent, or Firm*—Wenderoth, Lind & Ponack

[57] ABSTRACT

Textile materials are rendered flame retardant by applying a phosphorus-containing condensation product, a nitrogen-phosphorus-containing condensation product and an aminoplast precondensate to the textile material, and fixing them on the textile material.

17 Claims, No Drawings

PROCESS FOR TREATING TEXTILE ARTICLES

The present invention relates to a process for treating textile material to render the same flame-retardant. More specifically, the invention is concerned with a method of durable flame-retardant processing for textile material using a phosphorus-containing condensation product and a nitrogen-phosphorus-containing condensation product.

It is known that, among many textile goods, polyester/cotton blended products are most excellent for clothing use from the viewpoint of easy-care properties, strength, moisture absorbency, etc. However, the greatest defect of such blended products is their inflammability and extreme difficulty in rendering them flame-retardant. This results from a difference in flame retarding mechanisms between meltable fibers and non-meltable fibers, and it is very difficult to obtain flame-retardant blended products having a good hand for use as clothing and durability against repeated washing.

Phosphorus-containing condensation products obtained by self-condensation of a tetrakis(hydroxymethyl)phosphonium compound are known as flame retardants for textile use from U.S. Pat. No. 3,221,057 and Laid Open Japanese Patent Application 47-3345. These phosphorus-containing condensation products are used in combination with aminoplast precondensate, but because of their poor reactivity it is difficult to obtain durable flame retardancy when a large amount of aminoplast precondensate is not used. Therefore, it has been impossible to obtain durable flame retardancy which holds desirable softness and touch for use as clothing.

U.S. Pat. Nos. 3,878,245, 3,931,310 and 3,853,349 disclose nitrogen-phosphorus-containing condensation products obtained by heat-condensing a tetrakis(hydroxymethyl)phosphonium compound with an amino compound that can be methylolated such as urea, dicyandiamide, etc. These nitrogen-phosphorus-containing condensation products are those that are highly reactive, namely liable to become three-dimensional or insoluble on fibers, but because they form cross-linked resins having a high density, they lower the physical properties of the fibers, and in the case of thin fabrics of polyester/cellulose blend-spun products, it is difficult for them to provide said fabrics with an acceptable hand for use as clothing and good flame retardancy against repeated washing.

The present invention is a process for treating textile material to render the same flame-retardant which comprises applying to textile material (1) a phosphorus-containing condensation product obtained by self-condensing a tetrakis(hydroxymethyl)phosphonium compound, (2) a nitrogen-phosphorus-containing condensation product obtained by condensing a tetrakis(hydroxymethyl)phosphonium compound with an aminoplast precursor, (3) aminoplast precondensate, and if desired (4) an amino group-containing compound; and thereafter subjecting the textile material to a fixing treatment.

An object of the present invention is to impart to textile material, flame retardancy which is highly resistant to repeated washing without impairing its hand and the physical properties of the fiber.

Another object of the present invention is to impart excellent durable flame retardancy and also good hand to blends of meltable fibers and non-meltable fibers, especially to blend-spun products of polyester and cellulose, which are extremely difficult to render flame-retardant.

A further object of the present invention is to retain a softness and touch for clothing use also with respect to thin (light weight) fabrics of which the hand is liable to become stiff, and to impart durable flame retardancy to such fabrics.

A still further object of the present invention is to obtain reproducibility of durable flame retardant effect.

Other objects and effects of the present invention will become apparent from the following description.

In the present invention, a soft hand and durable flame retardancy are obtained by using in combination a phosphorus-containing condensation product, nitrogen-phosphorus-containing condensation product and aminoplast precondensate. Namely, by using a nitrogen-phosphorus-containing condensation product having a high affinity and high reactivity to hydrophobic synthetic fibers as a binder or fixing agent having flame retardancy, it becomes possible to effectively fix on fibers a phosphorus-containing condensation product having a high phosphorus content but poor in reactivity or affinity. Therefore, even when using a reduced amount of an aminoplast precondensate, it becomes possible to impart durable flame retardancy and consequently to obtain a soft hand.

The phosphorus-containing condensation products in the present invention are water-soluble or water-dispersible condensation products obtained through a dehydration reaction or dehydration and deformaldehydation reactions by heating a tetrakis(hydroxymethyl)phosphonium compound (hereinafter called THP compound) at a temperature between 120° and 200° C., preferably between 135° and 180° C. in a melted state or in the presence of an organic solvent. Among these phosphorus-containing condensation products, there may be recited the condensation product (presumed formula (I)) described in U.S. Pat. No. 3,221,057 which is obtained through dehydration condensation by heating a THP compound at 150° to 200° C. under bubbling of an inert gas:

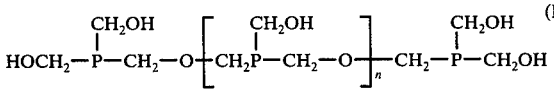

(I);

the condensation product (presumed formula (II)) described in Laid Open Japanese Patent Application 47-3345 obtained through dehydration condensation by heating a THP compound at 120° to 150° C. in a melted state or in the presence of an organic solvent:

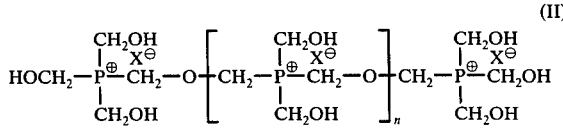

(II);

and the condensation product (presumed formula (III)) obtained through dehydration and deformaldehydation reactions by heating a THP compound in a melted state at 151° to 180° C. under a reduced pressure below 100 mmHg, preferably between 20 and 70 mmHg:

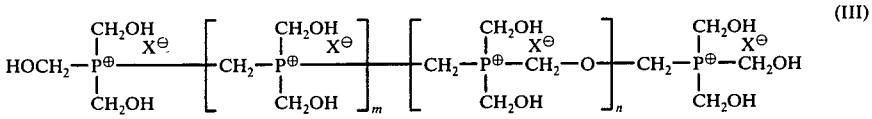

(III)

(m and n are positive integers; two middle structural units may be in block or random arrangement). In consideration of the reactivity, the condensation products as shown by the formulae (II) and (III) are preferable, and from the viewpoint of stability to hydrolysis and thermal decomposition, high phosphorus content and durability of flame retardant effect, the condensation product as shown by the formula (III) is especially preferable. In condensation at such high temperature under reduced pressure, condensation products having a large molar ratio P-$CH_2$-P linkage/P-$CH_2OCH_2$-P linkage are yielded, which ratio is obtained from the area intensities of the peaks at 1.7 δppm (P-$CH_2$-P linkage methylene proton) and 4.3 δppm (P-$CH_2OCH_2$-P linkage methylene proton) by means of nuclear magnetic resonance (NMR) spectrum in $D_2O$. However, generally a condensation product having such a molar ratio of 0.8 to 4.0 is preferable, and 1.0 to 2.0 is most preferable. Also, it is preferable that the specific viscosity of a 40% aqueous solution of the condensation product, measured at 30° C. should be 2 to 7. The condensation of a THP compound is performed under acidic conditions, preferably at a pH below 4, but since most THP compounds per se are acidic, no external catalyst is required. However, depending on the reaction composition, an acid or latent acid catalyst may be added. In the condensation reaction of a THP compound under reduced pressure, when an amino group-containing compound is added in an amount of 0.001 to 0.02 mol per mol of the THP compound, the deformaldehydation reaction is remarkably accelerated so that the lower limit of the reaction temperature can be lowered from a temperature above 150° C. to a temperature of 120° C. The preferable condensation temperature lies between 135° and 160° C. and at these temperatures, it is possible to obtain similar condensation products as those obtained by the condensation reaction at 151° to 180° C. in which no amino group-containing compound is used. These are also especially preferable phosphorus-containing condensation products that can be used in the present invention. Condensation products having a molar ratio P-$CH_2$-P linkage/$PCH_2OCH$-P linkage above 4.0 not only require a high temperature for their production but also may cause gellation under certain conditions, so that such condensation products are not practical.

If desired, the phosphorus-containing condensation products can be etherified at their free hydroxyl groups by an alcohol having 1 to 4 carbon atoms. Furthermore, if desired, the phosphorus-containing condensation products can be changed into their corresponding hydroxides with a strong base, for example an alkali hydroxide.

Among the amino group-containing compounds used as catalysts in the self-condensation of THP compounds, there may be exemplified aminoplast precursors or amino compound which can be methylolated and have at least two active hydrogen atoms selected from the group consisting of triazines such as melamine, N-alkylmelamine, ammeline, formoguanamine, acetoguanamine, benzoguanamine; urea or thiourea and their derivatives such as N-alkylurea, N-arylurea; cyclic ureas such as ethyleneurea, propyleneurea, triazones, urones, 4,5-dihydroxyethyleneurea; dicyandiamide; guanylureas; cyanamide; alkylcarbamates; acid amides; biuret; guanidines; etc.; and diamines such as ethylenediamine, propylenediamine. However, from the viewpoint of condensation accelerating effect, ethyleneurea, guanidine, melamine, urea and dicyandiamide are preferable and dicyandiamide is particularly preferable.

Among the nitrogen-phosphorus-containing condensation products, the components (2) of the present invention, water-soluble or water-dispersible condensation products obtained by co-condensing a THP compound with an aminoplast precursor generally in the ratio of 1 : 0.05 to 1.0, especially 1 : 0.2 0.8 in an aqueous system or in an organic solvent system or in a melted state, are preferable from the viewpoint of the effect as binder. The co-condensation is performed generally by heating under acidic conditions, especially at a pH below 5.5, at 80° to 150° C., preferably 100° to 120° C. for more than 10 minutes, preferably 30 to 150 minutes, but from the viewpoint of practice and effect as binder, water-soluble condensation products obtained in an aqueous system are particularly preferable. Depending on the reaction composition, an acid catalyst, for example a Lewis acid catalyst, may be added. As aminoplast precursors used in the co-condensation, there may be used the same aminoplast precursors as used as catalysts in the production of the above mentioned phosphorus-containing condensation products, but from the viewpoint of the reactivity, flame retardant effect and its durability, urea, biuret, oxalic diamide, thiourea, guanidine, dicyandiamide and melamine are preferable, and urea is particularly preferable.

Among the THP compounds, there may be recited tetrakis(hydroxymethyl)phosphonium chloride (hereinafter called THPC), tetrakis(hydroxymethyl)phosphonium bromide, tetrakis(hydroxymethyl)phosphonium phosphate, tetrakis(hydroxymethyl)phosphonium sulfate (hereinafter called THPS), tetrakis(hydroxymethyl)phosphonium acetate (hereinafter called THPA), tetrakis(hydroxymethyl)phosphonium oxalate and tetrakis(hydroxymethyl)phosphonium hydroxide. Among these, THPC, THPS and THPA are particularly preferable.

Among the aminoplast precondensates, the components (3) of the present invention, there may be recited addition products of aminoplast precursors and formaldehyde, and etherified products of said addition products by an alcohol having 1 to 4 carbon atoms, and methylolmelamine, methylouron, methyloltriazone, methylolalkylurea, methylol-4,5-dihydroxyethyleneurea, methylolalkylcarbamate and their methyl alcohol-etherified products are preferable. Among these, methylolmelamine and its methyl alcohol-etherified product are particularly preferable.

As the amino group-containing compounds, the components (4) of the present invention, there may be used the same amino group-containing compounds as used as catalysts in the production of the phosphorus-containing condensation products, but urea, thiourea, dicyandiamide, guanylurea, guanidine salts, formamide, sulfonylamide, phosphorylamide, cyanamide and biuret are preferable and among these, urea is particularly preferable.

The treatment process in the present invention is explained in the following: As regards the ratio of each component to be applied to textile material, the ratio of the component (1) (phosphorus-containing condensation product) to the component (2) (nitrogen-phosphorus-containing condensation product) should be normally 9:1 to 1:9, preferably 6:1 to 1:6 by weight. When the ratio of the component (1) is too large, the washing durability is lowered, and when the ratio of the component (2) is too large, not only does the hand become hard but also the flame retardancy is lowered. The ratio of the total of the component (1) and the component (2) to the component (3) (aminoplast precondensate) should be 80:20 to 99:1, preferably 85:15 to 95:5 by weight. As the ratio of the component (3) decreases, it becomes difficult to obtain the durability of flame retardancy against many times repeated washing, and on the other hand too large ratio of the component (3) stiffens the hand. The ratio of the total of the component (1) and the component (2) to the component (4) should be 80:20 to 100:0. By the addition of the component (4), the flame retardancy is elevated and at the same time the affinity to hydrophobic fibers is increased, thus making it possible to improve the durability of flame retardancy. However, the use of a large amount accelerates the three-dimensional network formation of the phosphorus-containing condensation product beyond the extent of need, and stiffens the hand. The use of far larger amounts hinders the three-dimensional network formation and lowers the durability. The ratio of the total of the component (1) and the component (2) to the total of the component (3) and the component (4) should be 70:30 to 99:1, and especially 80:20 to 95:5 is preferable. It is preferable that the components (1) to (4) should be normally applied to textile material as an aqueous treating solution at the same time. If desired, softening agents, antistatic agents, soil proofing agents and flame retardants other than the above mentioned may be added to the treating solution, and the pH of the treating solution should be preferably adjusted to 4 – 8 with a basic compound such as an alkali-metal hydroxide or alkali-metal carbonate. The treating solution is then applied to textile material by any of the means of spraying, padding, coating, transferring, etc. and thereafter the treated material is subjected to fixing treatment. The fixing treatment may be any of the wet-fixing method, moist-fixing method, ammonia-fixing method and thermo-fixing method, but from the viewpoint of practice and effect, the thermo-fixing method is particularly preferable. The thermo-fixing method is performed at 120° to 200° C. for 10 seconds to 30 minutes, after the treated textile material is usually dried. The amount of application of the flame retardant depends on the kind and weight of the textile material to be treated and the desired degree of flame retardancy, but usually the amount is 10 to 90 weight %, preferably 20 to 70 weight %, based on the weight of the fibers.

The textile materials to which the present invention is applicable include natural or regenerated cellulose fibers such as cotton, hemp, viscose rayon, cuprammonium rayon, polynosic rayon; protein fibers such as wool, silk, furs; semi-synthetic fibers such as cellulose acetate fiber, protein-acrylonitrile grafted copolymer fiber; synthetic fibers such as polyester, polyamide, polyacrylonitrile; various property-modified fibers such as antistaticity-modified synthetic fibers, flame retardancy-modified synthetic fibers, dye-affinity-modified synthetic fibers, which have been property-modified at any step during fiber production; and fiber masses, yarns, knit or woven fabrics, non-woven fabrics, carpets and rugs produced from these fibers and mixtures. When the flame retardant of the present invention is applied to mixtures of cellulose fibers and polyester fibers, which are usually difficult to render flame retardant, it can also provide flame retardant products having highly durable flame retardancy and a good hand.

The present invention is explained hereinafter by way of examples. In the examples, parts and percentages are by weight unless otherwise indicated.

SYNTHESES OF THE CONDENSATION PRODUCTS

I. Syntheses of the phosphorus-containing condensation products

I-A 1500 g. of an 80 % aqueous THPC solution (pH 0.8) was put into a two-liter four-mouthed flask equipped with a reduced pressure distillation apparatus, a thermometer and an air-tight stirrer. Under a reduced pressure of 60 mm Hg, the contents of the flask were gradually heated and brought to the boil, and 300 g. of water was distilled out. After the distillation of water was completed, the contents of the flask were further heated to 155° C. and were maintained at this temperature and reduced pressure for about one hour. During this time, 102 g. of water and 93 g. of formaldehyde and hydrochloric acid resulting from dehydration and deformaldehydation reactions and from a decomposition reaction were distilled out. After the completion of the reaction, 1005 g. of a condenstion product was obtained.

I-B 1500 g. of an 80 % aqueous THPC solution was put into a two-liter four-mouthed flask equipped with a reduced distillation apparatus, a thermometer and an air-tight stirrer. Under a reduced pressure of 30 mm Hg, the contents of the flask were gradually heated and brought to the boil, and 300 g. of water was distilled out. After the distillation of water was completed, the contents were further heated to 135° C. and were maintained at this temperature and reduced pressure for about three hours. During this time, 127 g. of water resulting from a dehydration reaction and a small amount of formaldehyde and hydrochloric acid (7 g. in total) resulting from a side reaction were distilled out, and 1066 g. of a condensation product was obtained.

I-C 150 g. of an 80 % aqueous solution and 150 g. of mixed m- and p-xylene were put into a one-liter four-mouthed flask equipped with an air-tight stirrer, a thermometer and a distillation apparatus, and the temperature was raised under vigorous stirring. When the temperature reached 104° C., the contents came to the boil and water was distilled out by the azeotropy with xylene. After water was distilled away, the contents were further heated and were condensed at 135° C. for 9.5 hours. The condensation product contained a volatile substance which irritated the eye.

I-D 1500 g. (6.3 mols) of 80 % THPC and 5.29 g. (0.063 mol) of dicyandiamide were put into a two-liter four-mouthed flask equipped with an air-tight stirrer, a thermometer and a reduced pressure distillation apparatus. Under a reduced pressure of 30 mm Hg, the contents of the flask were gradually heated and brought to the boil, and 300 g. of water was distilled out. After the completion of the distillation of water, the contents were further heated to 145° C. and were maintained at this temperature and reduced pressure for about one hour.

I-E to J Phosphorus-containing condensation products were synthesized in the same way as in I-D, but the kind and amount of amino group-containing compounds and reaction conditions were changed. The molar ratio P-$CH_2$-P linkage/P-$CH_2OCH_2$-P linkage, specific viscosity ($\eta_{sp}$) of 40 % aqueous solution measured at 30° C. with an Ostwald viscosimeter and the degree of the odor of the aqueous solution, of the obtained phosphorus-containing condensation products are summarized in Table 1.

Table 1

| | Condensation conditions | | | | | Properties of the condensation products | | | |
|---|---|---|---|---|---|---|---|---|---|
| | Catalyst | | | | | | | | |
| | Kind | Mol per mol of THPC | Reduced pressure (mm Hg) | Temp. (° C.) | Time (hrs.) | Specific viscosity ($\eta_{sp}$) | P—$CH_2$—P/ P—$CH_2OCH_2$—P (molar ratio) | Odor (garlic-like odor) | Elemental analysis (%) P |
| I-A | — | — | 60 | 155 | 1 | 2.8 | 1.1 | slight | 19.9 |
| I-B | — | — | 30 | 135 | 3 | 1.0 | 0.4 | considerable | |
| I-C | — | — | atm. pr. in xylene | 135 | 9 | 0.85 | 0.2 | " | |
| I-D | dicyan-diamide | 0.01 | 30 | 145 | 1 | 2.1 | 1.3 | almost no | 20.5 |
| I-E | " | 0.05 | 30 | 145 | 1 | 2.1 | 1.3 | " | |
| I-F | " | 0.2 | 60 | 155 | 1 | 3.3 | 1.7 | " | |
| I-G | ethylene-diamine | 0.01 | 60 | 155 | 1 | 2.8 | 1.3 | " | |
| I-H | guanidine-HCl | 0.01 | 60 | 155 | 1 | 3.0 | 1.4 | " | |
| I-I | melamine | 0.01 | 60 | 155 | 1 | 2.8 | 1.3 | slight | |
| I-J | urea | 0.01 | 60 | 155 | 1 | 2.9 | 1.3 | " | |
| I-K | — | — | 60 | 155 | 1.33 | 6.7 | 1.15 | " | |

II. Syntheses of the nitrogen-phosphorus-containing condensation products

II-A 205 g. (about 0.86 mol) of an 80 % aqueous THPC solution, 32.5 g. (0.54 mol) of urea, 8.2 g. (0.065 mol) of melamine and 232 g. of water were put into a one-liter three-mouthed flask equipped with a stirrer and a reflux condenser. The reaction mixture was heated under stirring and was condensed for one hour under reflux. This solution is an aqueous solution containing the active ingredient in 43 %.

II-B 1190 g. (5 mols) of an 80 % aqueous THPC solution was put into a two-liter three-mouthed flask equipped with a stirrer, a dropping funnel and a reflux condenser. The reaction solution was heated under stirring and a solution of 180 g. (3 mols) of urea in 250 g. of water was added under reflux. Thereafter, the reaction solution was condensed for two hours under reflux. This solution is an aqueous solution containing the active ingredient in 70 %.

EXAMPLE 1

A blend-spun broad cloth of polyester/cotton (65/35) was padded with a treating liquid of the following composition. After the cloth was squeezed to a wet pickup of 100 %, it was dried at 80° C. for 10 minutes and then heat-treated at 160° C. for three minutes. The cloth was then oxidation-treated in an aqueous solution containing 60 g/1 35 % hydrogen peroxide and 2 g/1 sodium carbonate at 40° C. for 20 minutes, and then it was rinsed with water and dried.

| Treating liquid: | |
|---|---|
| Phosphorus-containing condensation product I-A (80 % aqueous solution) (adjusted to pH 5 with a 20 % aqueous solution of sodium hydroxide before mixing) | X parts |
| Nitrogen-phosphorus-containing condensation product II-A (adjusted to pH 5 with a 20 % aqueous solution of sodium hydroxide before mixing) | Y parts |
| Sumitex Resin M-3 (Sumitomo Chemical Company, Limited; methoxylated methylolmelamine, with 80 % active ingredient) | 2 parts |
| Liponox NA (Lion Fat and Oil Co.; nonionic penetrating agent) | 0.1 part |
| Water | balance |
| Total | 120 parts |

The phosphorus content, flame retardancy and stiffness of the thus treated cloths were evaluated and the results in Table 2 were obtained.

Table 2

| | Experiment No. | Present invention 1 | Present invention 2 | Comparative examples 3 | Comparative examples 4 | Untreated |
|---|---|---|---|---|---|---|
| Flame retardant | I-A (80%, parts) | 50 | 40 | 80 | — | |
| | II-A (parts) | 30 | 40 | — | 80 | |
| | I-A/II-A (ratio of active ingredients) | 3/1 | 2/1 | 1/0 | 0/1 | |
| Flame retardancy | LOI 1) | 27.3 | 27.6 | 20.8 | 26.6 | 18.5 |
| Phosphorus content 2) | initial (%) | 3.0 | 3.2 | 0.5 | 2.3 | |
| Stiffness 3) | cantilever (mm) | 48 | 52 | 39 | 76 | 37 |
| | increase in stiffness (%) | 30 | 41 | 5 | 105 | |

1) LOI = Limiting Oxygen Index according to JIS K 7201
2) Colorimetric quantitative determination by molybdic acid
3) Stiffness JIS L 1004 5-17 A Method (warp direction)
Increase in stiffness (%)

$$= \frac{\text{Stiffness of treated cloth} - \text{Stiffness of untreated cloth}}{\text{Stiffness of untreated cloth}} \times 100$$

When the phosphorus-containing condensation product and the nitrogen-phosphorus-containing condensation product were used in combination, the flame retardants showed excellent fixing properties by virtue of the fixing effect (binder effect) of the nitrogen-phosphorus-containing condensation product with the use of the small amount of the aminoplast precondensate, and could impart a good hand and excellent flame retardancy to the cloth. But when the phosphorus-containing condensation product was used singly, it was difficult to fix it by the small amount of the aminoplast precondensate, and when the nitrogen-phosphorus-containing condensation product was used singly, it could be fixed by the aminoplast precondensate but the hand of the cloth was stiff.

EXAMPLE 2

A blend-spun lawn cloth of polyester/cotton (50/50) was padded with a treating liquid of the following composition. After the cloth was squeezed to a wet pickup of 100 %, it was dried at 80° C. for 10 minutes and then heat-treated at 160° C. for three minutes. Thereafter, in the same way as in Example 1, the cloth was oxidation-treated, rinsed with water and dried.

| Treating liquid: | |
|---|---|
| Phosphorus-containing condensation product (80% aqueous solution) (adjusted to pH 5.2 with a 20% aqueous solution of sodium hydroxide before mixing) | X parts |
| Nitrogen-phosphorus-containing condensation product (II-B) (adjusted to pH 5.2 with a 20% aqueous solution of sodium hydroxide before mixing) | Y parts |
| Urea | 0 or 2 parts |
| Sumitex Resin M-3 | 4 or 7 parts |
| Liponox NA | 0.1 part |
| Water | balance |
| Total | 120 parts |

The phosphorus content, flame retardancy and stiffness of the thus obtained cloths were evaluated and the results in Table 3 were obtained.

of flame retardancy to a further extent. Further, it is apparent from the comparison between No. 7 and Nos. 11 to 14, that the preferable use ratio of the phosphorus-containing condensation products to the nitrogen-phosphorus-containing condensation product is from 9:1 to 1:9, especially from 6:1 to 1:6. Additionally, among the phosphorus-containing condensation products, the condensation product I-A obtained by reacting at a temperature above 150° C. under reduced pressure and the condensation product I-D obtained by reacting in the presence of the amino group-containing compound catalyst under reduced pressure gave especially excellent durability. These condensation products were also excellent for their low emission of odor during the treatment.

EXAMPLE 3

A blend-spun lawn cloth of polyester/cotton (50/50) was padded with a treating liquid of the following composition. After the cloth was squeezed to a wet pickup of 110 %, it was dried, heat-treated, oxidation-treated, water-rinsed and dried in the same way as in Example 1.

| Treating liquid: | |
|---|---|
| Phosphorus containing condensation product (80% aqueous solution) (adjusted to pH 5) | 40 parts |
| Nitrogen-phosphorus-containing condensation product (II-B) (adjusted to pH 5) | 29 parts |
| Urea | X parts |
| Sumitex Resin M-3 | Y parts |
| Polyethylene glycol (MW 600) | 4 parts |
| Eleganol SRT-1 (Meisei Chemical Co.; fatty acid ester softener) | 3 parts |
| DIC Silicone Softener S (Dainippon Ink and Chemicals; dimethyl polysiloxane softener) | 0.5 part |
| Liponox NA | 0.1 part |
| Water | balance |
| Total | 135 parts |

Table 3

| | Experiment No. | Present invention 5 | 6 | 7 | 8 | 9 | 10 | 11 | 12 | 13 | 14 | Comparative examples 15 | 16 | 17 | 18 | Untreated |
|---|---|---|---|---|---|---|---|---|---|---|---|---|---|---|---|---|
| Composition (parts) | P-containing condensation product I-A | 40 | 40 | 40 | | | | 55 | 9 | | | | | | 65 | |
| | product I-B | | | | 40 | | | | | 60 | 5 | 65 | | | | |
| | product I-C | | | | | 40 | | | | | | | | 65 | | |
| | product I-D | | | | | | 40 | | | | | | | | | |
| | N-P-cont'g cond. prod. II-B | 29 | 29 | 29 | 29 | 29 | 29 | 10 | 63 | 5 | 70 | — | 75 | — | — | |
| | Urea | | | 2 | 2 | 2 | 2 | 2 | 2 | 2 | 2 | 2 | 2 | 2 | 2 | |
| | Sumitex Resin M-3 | 4 | 7 | 4 | 4 | 4 | 4 | 4 | 4 | 4 | 4 | 4 | 4 | 4 | 4 | |
| Flame retardancy 1) | Before washing | 10.8 | 10.5 | 9.1 | 12.0 | 13.1 | 9.0 | 9.5 | 10.6 | 12.0 | 10.6 | BEL | 10.6 | BEL | 13.0 | BEL |
| | After 20 times washing 4) | 12.3 | 11.3 | 9.5 | 15.0 | BEL | 9.2 | 10.3 | 12.0 | BEL | 12.3 | BEL | 12.3 | BEL | BEL | BEL |
| | After 50 times washing | BEL | 12.3 | 9.6 | BEL | BEL | 9.5 | BEL | 14.0 | BEL | BEL | BEL | BEL | BEL | BEL | BEL |
| Phosphorus content 2) (%) | Before washing | 3.8 | 4.5 | 4.5 | 3.3 | 3.0 | 4.5 | 3.7 | 4.1 | 3.3 | 3.8 | 2.5 | 3.8 | 2.2 | 3.2 | |
| | After 20 times washing | 3.4 | 3.9 | 4.2 | 3.0 | 2.5 | 4.2 | 3.2 | 3.5 | 2.6 | 3.2 | 2.0 | 3.2 | 1.9 | 2.8 | |
| | After 50 times washing | 2.9 | 3.3 | 3.8 | 2.5 | 2.2 | 3.9 | 2.8 | 3.0 | 2.0 | 2.9 | 1.6 | 2.8 | 1.5 | 2.4 | |
| Stiffness 3) | cantilever (mm) | 55 | 65 | 60 | 55 | 55 | 60 | 55 | 75 | 55 | 85 | 50 | 90 | 45 | 50 | 35 |
| | % increase | 57 | 86 | 71 | 57 | 57 | 71 | 57 | 114 | 57 | 143 | 43 | 157 | 29 | 43 | |

1) Char length (cm) accordingg to U.S. flame retardancy standard DOCFF 3-71 (average value of five test specimens) BEL: Burned entire length
2) Colorimetric quantitative determination by molybdic acid
3) JIS L-1004 5-7 Method (warp direction)
4) AATCC 124 III-B Method By using each of the phosphorus-containing condensation products and the nitrogen-phosphorus-containing condensation product in combination, it was possible to impart a good hand and excellent durable flame retardancy to the cloth being treated. This is supposed to have resulted from the fact that the nitrogen-phosphorus-containing condensation product acts as reactive binder not only to hydrophilic fibers but also to hydrophobic fibers and effectively fixes the phosphorus-containing condensation products which are poor in reactivity, by the co-operative effect with the aminoplast precondensate. Also, from the comparison between No. 5 and No. 7, it is seen that the combined use of the aminoplast precursor elevated the durability The phosphorus content, flame retardancy and stiffness of the treated cloths were evaluated and the results in Table 4 were obtained.

Table 4

| | Experiment No. | 19 | 20 | 21 | 22 | 23 | 24 | 25 | 26 | 27 | 28 | Untreated |
|---|---|---|---|---|---|---|---|---|---|---|---|---|
| Composition (parts) | P-containing condensation product I-A | 40 | 40 | 40 | | | | | | | | |
| | product I-E | | | | 40 | | | | | | | |
| | product I-F | | | | | 40 | | | | | | |
| | product I-G | | | | | | 40 | | | | | |
| | product I-H | | | | | | | 40 | | | | |
| | product I-I | | | | | | | | 40 | | | |
| | product I-J | | | | | | | | | 40 | | |
| | product I-K | | | | | | | | | | 40 | |
| | N-P-containing condensation product II-B | 29 | 29 | 29 | 29 | 29 | 29 | 29 | 29 | 29 | 29 | |
| | Urea | 2 | — | 14 | 2 | 2 | 2 | 2 | 2 | 2 | 2 | |
| | Sumitex Resin M-3 | 4 | 20 | 4 | 4 | 4 | 4 | 4 | 4 | 4 | 4 | |
| Flame retardancy 1) (cm) | Before washing | 9.1 | 9.5 | 10.8 | 8.7 | 9.3 | 9.5 | 9.1 | 9.2 | 9.3 | 9.3 | BEL |
| | After 50 times washing 2) | 10.1 | 10.0 | BEL | 9.2 | 10.2 | 10.3 | 10.1 | 10.8 | 10.4 | 10.5 | BEL |
| Phosphorus content (%) | Before washing | 4.4 | 4.9 | 4.9 | 4.5 | 4.5 | 4.5 | 4.4 | 4.5 | 4.5 | 4.4 | |
| | After 50 times washing 2) | 3.5 | 3.7 | 2.7 | 3.8 | 3.5 | 3.5 | 3.5 | 3.5 | 3.5 | 3.6 | |
| Stiffness 3) | Cantilever (mm) | 50 | 110 | 120 | 50 | 70 | 53 | 50 | 53 | 50 | 53 | 35 |
| | % increase in stiffness | 43 | 214 | 243 | 43 | 100 | 51 | 43 | 51 | 43 | 51 | |

1) Char length according to DOCFF 3-71 (average value of five test specimens) BEL: Burned entire length
2) AATCC 124 III-B Method
3) JIS L 1004 5-7 A Method By the combined use of each of the phosphorus-containing condensation products and the nitrogen-phosphorus-containing condensation product, excellent fixing was obtained and a good hand and durable flame retardancy could be imparted to the cloth, with a small amount of the aminoplast precondensate. However, when the use amount of the aminoplast precondensate or aminoplast plus urea was too large, the hand became stiff. Also, the hand became stiff when using the phosphorus-containing condensation product synthesized by using a large amount of an amino group-containing compound as catalyst.

EXAMPLE 4

A blend-spun shirting (45's × 45's/86 × 82) of Dacron T 900 F (E. I. Du Pont; flame retardancy-modified polyester fiber)/cotton (65/35) was padded with a treating liquid of the following composition. After the cloth was squeezed to a wet pickup of 82 %, it was dried at 80° C. for 7 minutes and then heat-treated at 160° C. for 3 minutes. Then the cloth was oxidation-treated, rinsed with water and dried in the same way as in Example 1.

| Treating liquid: | |
|---|---|
| Phosphorus-containing condensation product I-A (80% aqueous solution) (adjusted to pH 5.2 before mixing) | 28 parts |
| Nitrogen-phosphorus-containing condensation product II-B (adjusted to pH 5.2 before mixing) | 20 parts |
| Urea | 1.4 parts |
| Sumitex Resin M-3 | 2.8 parts |
| Polyethylene glycol (MW 600) | 2.8 parts |
| Eleganol SRT-1 | 2.1 parts |
| DIC Silicone Softener S | 0.4 parts |
| Liponox NA | 0.1 part |
| Water | balance |
| Total | 100 parts |

The phosphorus content, flame retardancy and stiffness of the treated cloth were evaluated and the results in Table 5 were obtained.

Table 5

| Experiment No. | | 29 | Untreated |
|---|---|---|---|
| Flame retardancy 1) (cm) | Before washing | 10.0 | BEL |
| | After 50 times washing 2) | 11.9 | BEL |
| Phosphorus content (%) | Before washing | 3.51 | — |
| | After 50 times washing 2) | 2.91 | — |
| | % retension | 83 | |
| Stiffness | cantilever 3) (mm) | 65 | 60 |
| | increase in stiffness (%) | 10 | |

1) Char length according to DOCFF 3-71 Method (average value of five test specimens) BEL: Burned entire length
2) AATCC 124 III-B Method
3) JIS L 1004 5-17 A Method (sum of the values in the warp and filling directions)

By treating the blend-spun cloth of the flame retardancy-modified polyester/cotton with this treating liquid, a good hand and durable flame retardancy were obtained.

EXAMPLE 5

A phosphorus-containing condensation product was synthesized using 500 g. of 80 % THPS and 25 g. of sodium chloride in the same way as in I-A. Sodium sulfate which formed during synthesis of this condensation product and at neutralization of the agent with sodium hydroxide was removed by filtration before treating the fabric. Treatment was carried out using this condensation product under the same conditions as in Experiment No. 7 of Example 2, with the result that a good hand and excellent flame retardancy which passes the DOCFF 3-71 standard after 50 times washing were obtained.

EXAMPLE 6

A phosphorus-containing condensation product was synthesized using 500 g. of 80 % THPA which was adjusted to a pH of 1.0 with hydrochloric acid aqueous solution in the same way as in I-A. Treatment was carried out using this condensation product under the same conditions as in Experiment No. 7 of Example 2, with the result that a good hand and excellent flame retardancy which passes the DOCFF 3-71 standard after 50 times washing were obtained.

EXAMPLE 7

In the same way as for the nitrogen-phosphorus-containing condensation product II-A, 80 % THPC was condensed with each of the aminoplast precursors in Table 6 in the molar ratios shown in said table.

Table 6

| Nitrogen-phosphorus-containing condensation product | 80% THPC g.(mol) | Aminoplast precursor Kind | Aminoplast precursor g(mol) | Water (g) | Total (g) | Active Active ingre- (%) |
|---|---|---|---|---|---|---|
| II-C | 238 (1) | Urea | 36.0 (0.6) | 252 | 526 | 43 |
| II-D | 238 (1) | Dicyandiamide | 67.3 (0.8) | 294.7 | 600 | 43 |
| II-E | 238 (1) | Guanylurea phosphoric acid salt | 120 (0.6) | 364 | 722 | 43 |
| II-F | 238 (1) | Thiourea | 15.2 (0.2) | 224.8 | 478 | 43 |
| II-G | 238 (1) | N,N',N''-trimethylphosphoric amide* | 73.1 (0.53) | 301.9 | 613 | 43 |

*A crude product containing a little amount of HCl

Treatment was carried out using each of the obtained nitrogen-phosphorus-containing condensation products under the same conditions as in Experiment No. 2 of Example 1, with the result that the cloth treated with II-C showed the same excellent flame retardancy as that of Experiment No. 2. The cloth treated with II-D, II-E or II-F also showed a good flame retardancy but inferior to some extent to that treated with II-C. The cloth treated with II-G showed a lower content of phosphorus and somewhat lower fixing efficiency and flame retardancy than any of the above mentioned treated cloths. The hand was good in every case.

EXAMPLE 8

In place of urea in the treating liquid in Experiment No. 19 of Example 3, treatment was carried out using the same amount of guanidine hydrochloride, dicyandiamide, thiourea, or ammonium sulfamate, under the same conditions as in Example 3, with the result that the cloth treated with the treating liquid containing guanidine hydrochloride or dicyandiamide had somewhat lower flame retardancy than the cloth of Experiment No. 19 but had sufficient flame retardancy and a good hand. The cloth treated with the treating liquid containing thiourea had a somewhat stiffer hand than the treated cloth of Experiment No. 19 but had the same degree of excellent flame retardancy. The cloth treated with the treating liquid containing ammonium sulfamate was somewhat inferior in the durability but had acceptable flame retardancy and a good hand.

What is claimed is:

1. A process for rendering a textile material flame retardant, which comprises applying to the textile material (1) a phosphorus-containing condensation product obtained (A) by heating a tetrakis(hydroxymethyl)phosphonium compound at 151° – 180° C. at reduced pressure under acidic conditions to condense said phosphonium compound through dehydration and deformaldehydation reactions, the molar ratio of P-$CH_2$-P linkage/P-$CH_2OCH_2$-P linkage in said condensation product being 0.8 – 4.0, or (B) by heating a tetrakis(hydroxymethyl)phosphonium compound at 120° – 180° C. in the presence of 0.001 – 0.02 mol of an amino group-containing compound per mol of said phosphonium compound at reduced pressure under acidic conditions to condense said phosphonium compound through dehydration and deformadelhydation reactions, the molar ratio of P-$CH_2$-P linkage/P-$CH_2OCH_2$-P linkage in said condensation product being 0.8 – 4.0, (2) a nitrogen-phosphorus-containing condensation product obtained by condensing a tetrakis(hydroxymethyl)phosphonium compound with an aminoplast precursor, and (3) an aminoplast precondensate, the weight ratio of (1):(2) being from 90:10 to 10:90 and the weight ratio of (1) + (2) : (3) being from 80:20 to 99:1; and fixing (1), (2) and (3) on the textile material.

2. The process as claimed in claim 1 wherein an amino group-containing compound as a fourth component (4) is used in combination with components (1), (2) and (3).

3. The process of claim 2 wherein, the ratio by weight of (1) + (2) : (4) is 80:20 to 100:0 and the ratio by weight of (1) + (2) : (3) + (4) is 70:30 to 99:1.

4. The process as claimed in claim 2 wherein the amino group-containing compound for component (4) is urea.

5. The process as claimed in claim 1 wherein component (1) is obtained by the method (A).

6. The process as claimed in claim 1 wherein component (1) is obtained by the method (B).

7. The process as claimed in claim 6 wherein the amino group-containing compound is an aminoplast precursor that can be methylolated.

8. The process as claimed in claim 6 wherein the amino group-containing compound is dicyandiamide.

9. The process as claimed in claim 1 wherein the nitrogen-phosphorus-containing condensation product is a condensation product obtained by reacting a tetrakis(hydroxymethyl)phosphonium compound with an aminoplast precursor in the molar ratio of 1:0.05 to 1.0 at 80° – 150° C. under acidic conditions.

10. The process as claimed in claim 9 wherein the aminoplast precursor is urea, thiourea, guanidine, biuret, dicyandiamide or melamine.

11. The process as claimed in claim 9 wherein the aminoplast precursor is urea.

12. The process as claimed in claim 1 wherein the nitrogen-phosphorus-containing condensation product is a condensation product obtained by reacting a tetrakis(hydroxymethyl)phosphonium compound with an aminoplast precursor in the molar ratio of 1:0.2 to 0.8 at 100° – 120° C. at a pH below 5.5 in an aqueous system.

13. The process as claimed in claim 1 wherein the aminoplast precondensate is methylolmelamine or its methyl alcoholetherified product.

14. The process as claimed in claim 1 wherein the fixing treatment is a thermo-fixing treatment at 120° – 200° C. for 10 seconds to 30 minutes.

15. The process as claimed in claim 1 wherein the textile material is a blended product of polyester fibers and cellulose fibers.

16. A composition for treating a textile material to render the textile material flame retardant, which comprises the components (1), (2) and (3) as described in claim 1 in the weight ratios as described in claim 1.

17. Textile material treated by the process of claim 1.

* * * * *